United States Patent [19]

Maldonado

[11] Patent Number: 5,013,068

[45] Date of Patent: May 7, 1991

[54] STRETCHABLE, WATER REPELLANT BOOK COVER

[76] Inventor: David J. Maldonado, 2357 Fifth St., La Verne, Calif. 91750

[21] Appl. No.: 498,411

[22] Filed: Mar. 26, 1990

[51] Int. Cl.[5] ..... B42D 3/00; A45F 5/12

[52] U.S. Cl. ..... 281/31; 206/424; 281/29; 281/34; 281/35

[58] Field of Search ..... 206/424, 450; 281/34, 281/31, 35, 29

[56] References Cited

U.S. PATENT DOCUMENTS

| | | | |
|---|---|---|---|
| 2,946,604 | 7/1960 | Hunger et al. | 281/34 |
| 3,215,450 | 11/1965 | Peterson et al. | 281/29 |
| 3,318,618 | 5/1967 | Mullen et al. | 281/29 |
| 3,483,965 | 12/1969 | Rosenblatt et al. | 206/424 |
| 4,111,460 | 9/1978 | Roberts | 281/29 |

FOREIGN PATENT DOCUMENTS

| | | | |
|---|---|---|---|
| 1033636 | 7/1958 | Fed. Rep. of Germany | 281/34 |
| 1091364 | 4/1955 | France | 281/35 |
| 2438549 | 6/1980 | France | 281/34 |
| 444487 | 3/1936 | United Kingdom | 281/34 |
| 905483 | 9/1962 | United Kingdom | 281/34 |

*Primary Examiner*—Bryon P. Gehman

*Attorney, Agent, or Firm*—William W. Haefliger

[57] ABSTRACT

A protective envelope for a book having front and rear covers, and a binding area, the envelope comprising, a stretchable sheet defining front and rear sections adapted to closely overlie the front and rear book covers, the sheet having edges; a stretchable seam binding extending in a loop and attached to the edges; the front and rear sections having outer and inner sides, and including stretchable flaps extending adjacent the book cover side of the sheet sections, the flaps peripherally attached to the sheet section to form pockets for reception of the book covers into the respective pockets in conformed, retained position therein.

12 Claims, 2 Drawing Sheets

STRETCHABLE, WATER REPELLANT BOOK COVER

BACKGROUND OF THE INVENTION

This invention relates generally to protective envelopes or sleeves for books, and more particularly to a novel envelope which has a number of advantages including bi-directional stretchability to conform to book covers to which the envelope is removably attached.

There is continual need for durable, protective book covering envelopes, prior covers made for example of heavy paper being destructible, and subject to tearing and rapid wear. Also, prior envelopes tended to slip relative to the book covers, became are loose on the book covers.

SUMMARY OF THE INVENTION

It is a major object of the invention to provide an envelope that has many advantages and that meets the above need. Among such advantages are: durability, long wearability, conformability as a result of stretchability, water resistance, ease of cleaning, and ease of fitting to a book. Basically, the envelope includes:

(a) a stretchable sheet defining front and rear sections adapted to closely overlie the front and rear book covers, said sheet having edges, (b) a stretchable seam binding extending in a loop and attached to such edges, (c) the front and rear sections having outer and inner sides, and including stretchable flaps extending adjacent the inner sides of the sheet sections to partially cover such inner sides, the flaps peripherally attached to said sheet sections to form pockets for reception of the book covers into the respective pockets in conformed, retained, non-slip condition therein.

Another object is to provide a book covering envelope wherein book covers are partially received in the pockets, with the flaps, sheet sections and seam binding at least locally stretched by the book covers.

As will appear, the seam binding typically and locally has U-shape in cross-section, with legs stitched compressively to edge portions of the sheet sections. The stitching may compressively deform the sheet edges and the flap edges, firmly holding them together and providing a tear resistant, protective, outwardly rounded configuration of the seam binding at the envelope borders. In this regard, the sheet is typically one continuous generally rectangular sheet having two longitudinally elongated edges and two laterally elongated edges, and the seam binding extends in a loop adjacent the four elongated edges of the sheet. Also, the binding loop may be locally curved at corners defined by merging of said longitudinal and lateral edges.

Another object is to provide straps extending laterally between longitudinal extents of the seam binding loop to retain the book covers, near the book binding, and at the inner sides of the sheet sections, the straps spaced from the pockets.

Additional objects include providing the sheet outer sides to be smooth and to exhibit high light reflectivity in related coloration, for ease of identification of a book, the seam binding preferably being dark to exhibit high contrast to the reflective outer side surface of the sheet.

These and other objects and advantages of the invention, as well as the details of an illustrative embodiment, will be more fully understood from the following specification and drawings, in which:

DRAWING DESCRIPTION

Figure 4:
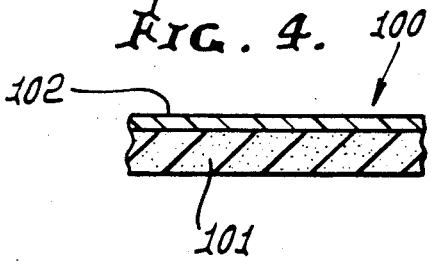
FIG. 4 is a view of a section of the envelope sheet.
Figure 3:
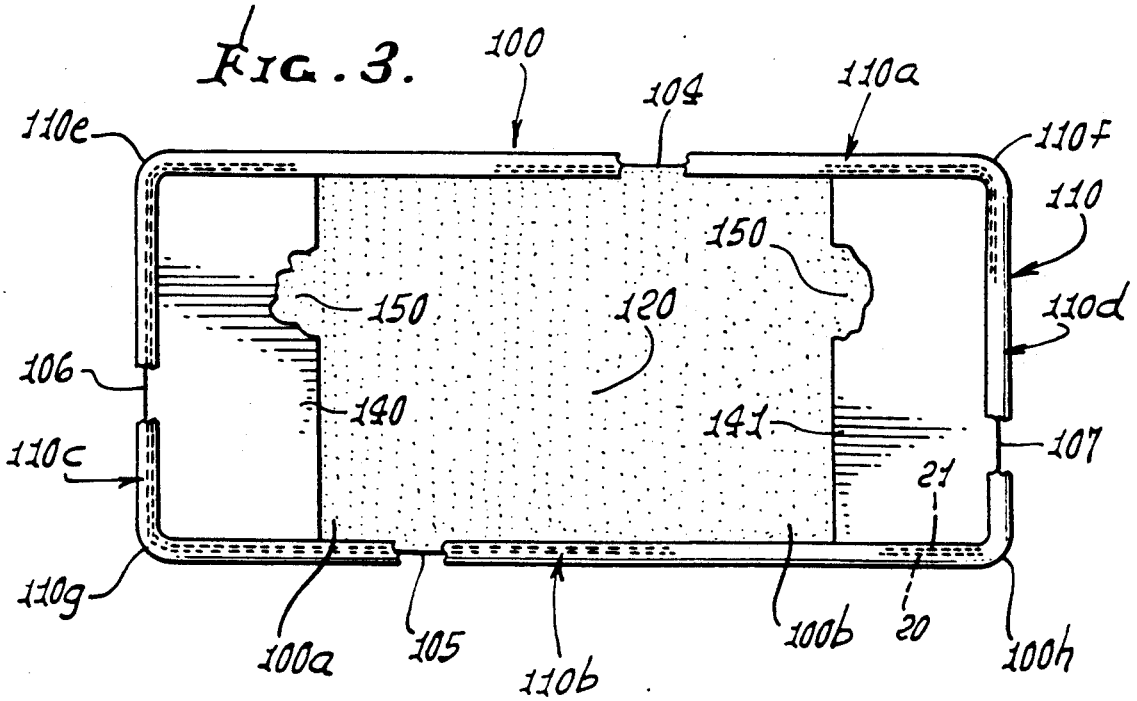
FIG. 3 is a plan view of the inner side of the book envelope, in open position.
Figure 5:
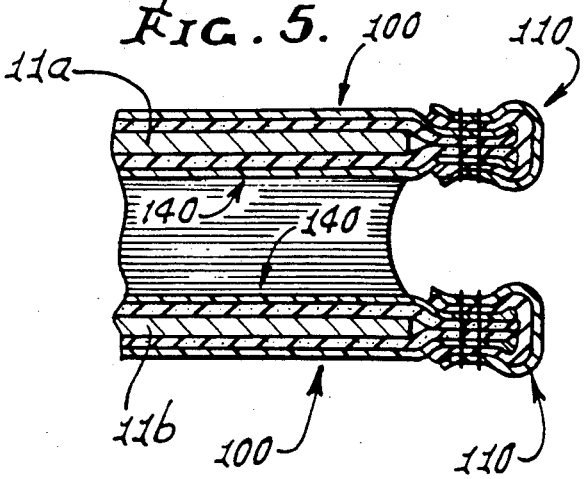
Figure 4A:
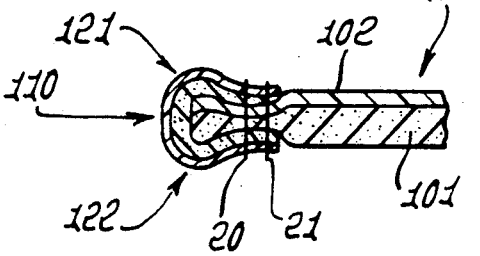
Figure 6:
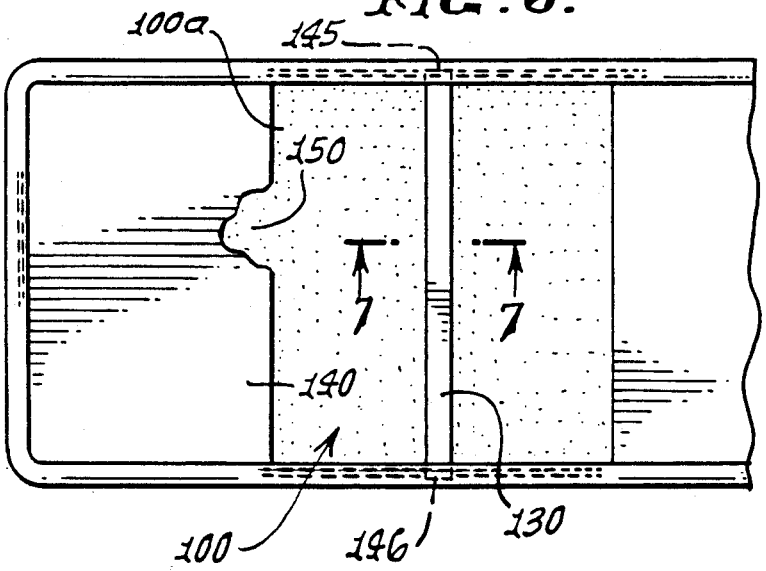
Figure 7:
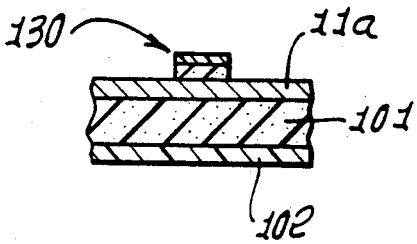

FIG. 4*a* is a view like FIG. 4, showing seam binding attached to the sheet edge;

FIG. 5 is an enlarged view taken in section showing the envelope in the form of front and rear sections enveloping book front and rear covers;

FIG. 6 is a fragmentary view showing the envelope of FIG. 3 with a book cover retaining strap;

FIG. 7 is a section taken on lines 7—7 of FIG. 6; and

Figure 8:
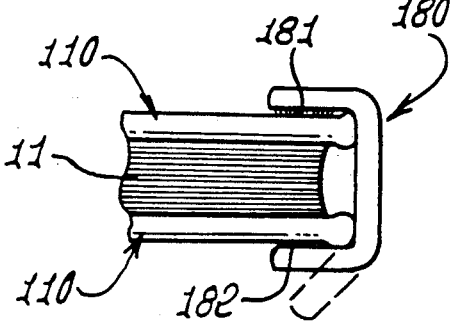

FIG. 8 shows an attachement strap on the envelope.

DETAILED DESCRIPTION

Figure 1:
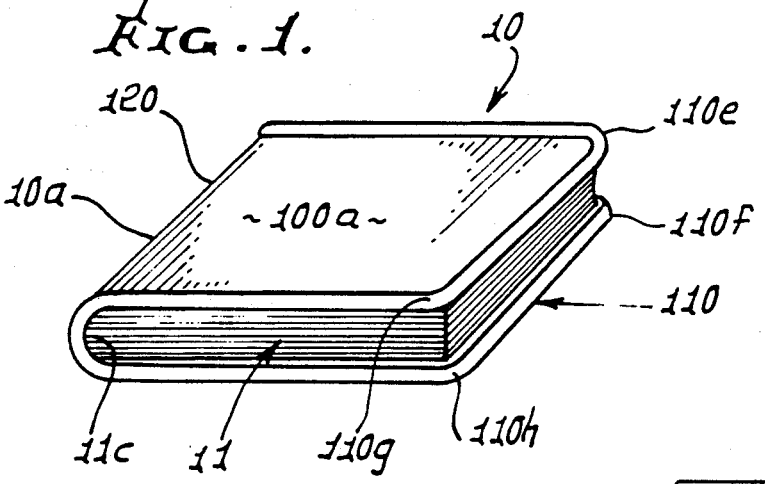
FIG. 1 is a perspective view of a book envelope, in use.
Figure 2:
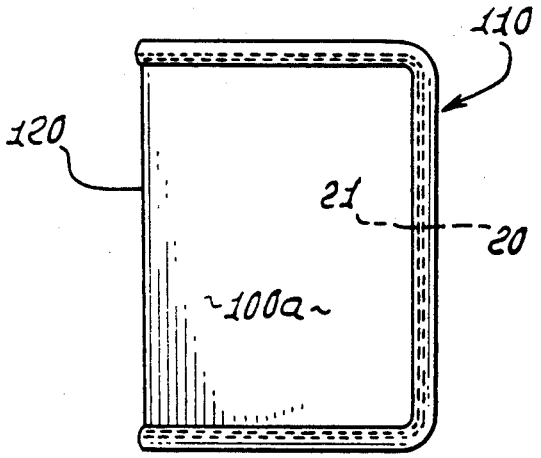
FIG. 2 is a top plan view of the FIG. 1 envelope.

In FIGS. 1, 2 and 5, a protective envelope 10 for a book 11 embraces book front and rear covers 11*a* and 11*b*, and folds at 10*a* over the book binding area or region 11*c*. The envelope 10 comprises a sheet 100 seen in FIG. 4 to include a relatively thick layer 101 of closed cell elastomeric compressible foam, lined on one side with a relatively thin layer 102 of compressible synthetic polymer fabric. Thus, sheet 100 is a composite. Examples are foamed NEOPRENE (at 101) and stretchable NYLON (at 102). The foam has a thickness between 1/32 inch and 1/16 inch, and the layer 102 is thinner than the foam layer. Both are bi-directionally stretchable (in all directions) to best conform to the book cover extents which they envelope. The sheet 100 may consist of the commercial product known as STARSKIN, 3 mm #1 smooth skin plush royal 403, produced by St. Albans Rubber Ltd., St. Albans, Herts, England.

The continuous sheet 100, when folded to conform to book folding, defines front and rear sections 100*a* and 100*b* adapted to closely overlie the front and rear book covers 11*a* and 11*b* thereby to define an envelope. When unfolded, as in FIG. 3, the sheet 100 has longitudinal edges 104 and 105, as well as lateral edges 106 and 107, and therefore is generally rectangular.

Bi-directionally stretchable seam binding 110 extends in a loop about edges 104–107 and is attached to those edges to provide a protective, convexly outwardly rounded soft, non-tearable border for the envelope. The binding includes stretch 110*a* extending along sheet edge 104; stretch 110*b* extending along sheet edge 105; stretch 110*c* extending along sheet edge 106; and stretch 110*d* extending along sheet edge 107. At the four corners of the envelope, the binding is protectively rounded as at 110*e*–110*h*. The smooth NYLON layer 102 of sheet 100 is typically presented outwardly, for manual grasping, and the foamed elastomeric layer 101 is typically presented inwardly for frictional contact with the book cover or covers, and with the book covering at the book binding area. See sheet zone 120. The NYLON layer may embody a bright coloring, know as "NEON" (fluorescent) or "DAY-GLO" color; and the seam binding may be dark in color. The seam binding may consist of the same material as the sheet 100. Thus, carriage of the book by a student provides a safety factor, as at street crossings, or being highly visible to a motorist.

FIG. 4*a* shows that the seam binding, in section, has U-shape, i.e. channel shape, with the legs 121 and 122 of the channel compressively sewn or stretched to the edge portions of the sheet 100, as at two spaced locations 20 and 21 extending lengthwise along that edge portion of the sheet. The stitching holds the layers 101 and 102, at the edges, in compressed condition, whereby a very durable edge protection is afforded, as when a book is frequently dropped by children.

Also provided are stretchable flaps 140 and 141 extending adjacent the inner sides of the sheet sections 100*a* and 100*b*, to partially cover the latter. The flaps are peripherally attached along three edges thereof, to the edges of the sheet sections, to thereby form pockets (as at 150) for reception of the book cover into the pockets, for retention of the envelope to the book, and vice versa. See the typical construction shown in FIG. 5. The seam binding is used to extend over both the edges of the sheets and of the flaps, and the stitching compresses the two together, and attaches the assembly, as shown. The book cover is thereby held in position, and the bi-directionally stretchable construction of the sheets, flaps, and seam binding accommodates the envelope to the book cover.

FIGS. 6 and 7 show a strap 130 extending over the book cover near the binding zone. Opposite ends of the strap are retained to edges of the sheet 100, as by the seam binding. See locations 145 and 146. The strap may consist of the same bi-directionally stretchable material as the sheet 100, for ease of manipulation during insertion of the book cover under the strap and into the pocket 150 formed by flap 140 and sheet section 100*a*. This is particularly of advantage when a paper-back flexible book cover is to be retained in this position. A book cover 11*a* is shown in place in FIG. 7.

FIG. 8 shows a latching strap 180 attached to the envelope, as by VELCRO, at locations 181 and 182.

I claim:

1. A protective envelope for a book having front and rear covers, and a binding area, said envelope comprising, in combination with said book;

(a) a stretchable sheet defining front and rear sections adapted to closely overlie said front and rear book covers, said sheet having edges, (b) a stretchable and separate seam binding extending in a loop and attached to said edges, (c) said front and rear sections having outer and inner sides, and including stretchable flaps extending adjacent said inner sides of the sheet sections to partially cover said inner sides, said flaps peripherally attached to said sections to form pockets for reception of the book covers into the respective pockets, in conformed, retained position therein, (d) said sheet including a first layer of closed cell elastomeric, compressible foam, and a second layer of compressible, synthetic, polymer fabric, said second layer lining said first layer on one side thereof and being substantially thinner than said first layer, said first layer presented inwardly for frictional contact with the book cover or covers, and the second layer presented outwardly for manual grasping.

2. The combination of claim 1 wherein said book covers are partially received in the pockets, with the flaps, sheet sections and seam binding at least locally stretched by the book covers.

3. The combination of claim 2 including a latch piece extending into overlapping relation with said front and rear sections of said stretchable sheet.

4. The combination of claim 1 wherein the seam binding has U-shape in cross-section, with legs compressively stitched to edge portions of the sheet sections.

5. The combination of claim 4 including a double row of stitches stitching the seam binding to said sheet edge portions.

6. The combination of claim 1 wherein said sheet is one continuous generally rectangular sheet having two longitudinally elongated edges and two laterally elongated edges, and said seam binding extends in a loop adjacent said four elongated edges of the sheet.

7. The combination of claim 6 wherein the seam binding loop is locally curved at corners defined by merging of said longitudinal and lateral edges.

8. The combination of claim 6 including straps extending laterally between longitudinal extents of the seam binding loop to retain the book covers near said binding, and at the inner sides of the sheet sections, said straps spaced from the pockets.

9. The combination of claim 1 wherein said sheet has outer sides which are smooth and highly reflective to light.

10. The combination of claim 9 wherein said seam binding is outwardly convex, and dark in color.

11. The combination of claim 1 wherein the layers are adherent to one another and each bi-directionally stretchable.

12. The combination of claim 11 wherein the seam binding has the same composition as the sheet.

* * * * *